US012692860B2

(12) United States Patent
Wiesenack et al.

(10) Patent No.: US 12,692,860 B2
(45) Date of Patent: Jul. 28, 2026

(54) METHOD FOR OPERATING A CONSTRUCTION-MATERIAL AND/OR VISCOUS-MATERIAL PUMP FOR CONVEYING CONSTRUCTION MATERIAL AND/OR VISCOUS MATERIAL, AND CONSTRUCTION-MATERIAL AND/OR VISCOUS-MATERIAL PUMP FOR CONVEYING CONSTRUCTION MATERIAL AND/OR VISCOUS MATERIAL

(71) Applicant: Putzmeister Engineering GmbH, Aichtal (DE)

(72) Inventors: Carl Wiesenack, Munich (DE); Benjamin Hoelzle, Bad Urach (DE); Michael Schaefer, Gaeufelden-Tailfingen (DE); Wolf-Michael Petzold, Aichwald (DE); Jan-Martin Veit, Pliezhausen (DE); Ralf Weimer, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 123 days.

(21) Appl. No.: 18/012,712

(22) PCT Filed: Jun. 7, 2021

(86) PCT No.: PCT/EP2021/065100
§ 371 (c)(1),
(2) Date: Dec. 23, 2022

(87) PCT Pub. No.: WO2021/259620
PCT Pub. Date: Dec. 30, 2021

(65) Prior Publication Data

US 2023/0265843 A1 Aug. 24, 2023

(30) Foreign Application Priority Data

Jun. 26, 2020 (DE) ..... 10 2020 207 970.6

(51) Int. Cl.
*F04B 49/10* (2006.01)
*F04B 7/00* (2006.01)
(Continued)

(52) U.S. Cl.
CPC ..... *F04B 49/106* (2013.01); *F04B 7/0049* (2013.01); *F04B 9/1172* (2013.01);
(Continued)

(58) Field of Classification Search
CPC .... F04B 49/106; F04B 7/0049; F04B 9/1172; F04B 15/02; F04B 49/065; F04B 49/20;
(Continued)

(56) References Cited

U.S. PATENT DOCUMENTS 5,316,453 A 5/1994 Schwing
5,388,965 A 2/1995 Fehn
(Continued)

FOREIGN PATENT DOCUMENTS

CN 1088664 A 6/1994
CN 104541054 A 4/2015
(Continued)

OTHER PUBLICATIONS

DE102013104494A1 translation (Year: 2024).*
(Continued)

*Primary Examiner* — David N Brandt
(74) *Attorney, Agent, or Firm* — Crowell & Moring LLP

(57) ABSTRACT

A method operates a construction material and/or viscous-material pump having: at least one conveying cylinder, the conveying cylinder being designed to receive and discharge construction material and/or viscous material; and at least one conveying piston, the conveying piston being disposed in the conveying cylinder for movement in order to draw construction material and/or viscous material into the conveying cylinder and to displace drawn-in construction mate-
(Continued)

rial and/or viscous material out of the conveying cylinder. The method includes: conveying construction material and/or viscous material, by movement of the conveying piston in order to draw in and displace construction material and/or viscous material; sensing a position variable during the movement, the position variable characterizing a position of the conveying piston along its stroke in the conveying cylinder; sensing a conveying variable during the movement, the conveying variable being of a different type than the position variable and characterizing the conveying of construction material and/or viscous material by the pump; and determining a profile of a subsequent movement of the conveying piston by linking the sensed position variable and the sensed conveying variable to each other; and controlling the subsequent movement in accordance with the determined profile.

1 Claim, 5 Drawing Sheets

(51) Int. Cl.

| | |
|---|---|
| ***F04B 9/117*** | (2006.01) |
| ***F04B 15/02*** | (2006.01) |
| ***F04B 49/06*** | (2006.01) |
| ***F04B 49/08*** | (2006.01) |
| ***F04B 49/20*** | (2006.01) |

(52) U.S. Cl.
CPC ..... *F04B 15/02* (2013.01); *F04B 49/065* (2013.01); *F04B 49/20* (2013.01); *F04B 7/0026* (2013.01); *F04B 49/08* (2013.01); *F04B 2201/0201* (2013.01); *F04B 2201/0202* (2013.01); *F04B 2201/0203* (2013.01); *F04B 2201/0206* (2013.01); *F04B 2201/0209* (2013.01); *F04B 2205/05* (2013.01); *F04B 2205/09* (2013.01)

(58) Field of Classification Search
CPC ..... F04B 7/0026; F04B 49/08; F04B 2201/0201; F04B 2201/0202; F04B 2201/0203; F04B 2201/0206; F04B 2201/0209; F04B 2205/05; F04B 2205/09
See application file for complete search history.

(56) References Cited

U.S. PATENT DOCUMENTS

| | | | |
|---|---|---|---|
| 6,779,983 | B1 | 8/2004 | Olson |
| 2003/0170127 | A1 | 9/2003 | Muenzenmaier et al. |
| 2005/0166978 | A1 | 8/2005 | Brueckmann et al. |
| 2006/0245942 | A1 | 11/2006 | Hofmann et al. |
| 2006/0245943 | A1 | 11/2006 | Hofmann et al. |
| 2007/0196219 | A1 | 8/2007 | Hofling et al. |
| 2012/0076666 | A1 | 3/2012 | Romain |
| 2015/0096290 | A1 | 4/2015 | Veit et al. |
| 2015/0211503 | A1 | 7/2015 | Hofmann et al. |

FOREIGN PATENT DOCUMENTS

| | | | | | |
|---|---|---|---|---|---|
| CN | 121057891 | A | | 12/2025 | |
| DE | 40 35 518 | A1 | | 5/1992 | |
| DE | 10 2004 029 231 | A1 | | 7/2005 | |
| DE | 10 2004 015 415 | A1 | | 10/2005 | |
| DE | 102013104494 | A1 | * | 11/2014 | ..... F04B 15/02 |
| JP | 6-42452 | A | | 2/1994 | |
| JP | 7-4351 | A | | 1/1995 | |
| JP | 7-42667 | A | | 2/1995 | |
| JP | 2005-36678 | A | | 2/2005 | |
| JP | 2011241725 | A | * | 12/2011 | |
| JP | 2013-194562 | A | | 9/2013 | |
| KR | 2003-0015369 | A | | 2/2003 | |
| KR | 10-2006-0127383 | A | | 12/2006 | |
| KR | 10-2015-0018768 | A | | 2/2015 | |

OTHER PUBLICATIONS

JP2011241725A translation (Year: 2025).*
International Search Report (PCT/ISA/210) issued in PCT Application No. PCT/EP2021/065100 dated Aug. 2, 2021 with English translation (four (4) pages).
German-language Written Opinion (PCT/ISA/237) issued in PCT Application No. PCT/EP2021/065100 dated Aug. 2, 2021 (11 pages).
Japanese-language Office Action issued in Japanese Application No. 2022-577142 dated Nov. 19, 2024 with English translation (13 pages).
Korean-language Office Action issued in Korean Application No. 10-2022-7044354 dated Jun. 26, 2025 with English translation (14 pages).
Japanese-language Office Action issued in Japanese Application No. 2022-577142 dated Aug. 26, 2025 with English translation (11 pages).
Chinese-language Office Action issued in Chinese Application No. 202180045057.1 dated Dec. 17, 2025 with English translation (19 pages).
Korean Decision to Grant issued in Korean Application No. 10-2022-7044354 dated Mar. 30, 2026 with partial English translation (6 pages).

* cited by examiner

METHOD FOR OPERATING A CONSTRUCTION-MATERIAL AND/OR VISCOUS-MATERIAL PUMP FOR CONVEYING CONSTRUCTION MATERIAL AND/OR VISCOUS MATERIAL, AND CONSTRUCTION-MATERIAL AND/OR VISCOUS-MATERIAL PUMP FOR CONVEYING CONSTRUCTION MATERIAL AND/OR VISCOUS MATERIAL

FIELD OF USE AND PRIOR ART

The invention relates to a method for operating a construction material and/or thick matter pump for conveying construction material and/or thick matter, and to a construction material and/or thick matter pump for conveying construction material and/or thick matter.

Problem and Solution

It is the object of the invention to provide a method for operating a construction material and/or thick matter pump for conveying construction material and/or thick matter, and to provide a construction material and/or thick matter pump for conveying construction material and/or thick matter, which each have improved characteristics.

The invention achieves said object by providing a method and by providing a construction material and/or thick matter pump, having the features of the independent claims. The dependent claims describe advantageous refinements and/or embodiments of the invention.

The in particular automatic method according to the invention is designed or configured or provided for the in particular automatic operation of a construction material and/or thick matter pump for in particular automatically conveying construction material and/or thick matter. The construction material and/or thick matter pump comprises or has at least one conveying cylinder and at least one conveying piston. The conveying cylinder is designed or configured to in particular directly receive and in particular directly discharge construction material and/or thick matter. The conveying piston is arranged movably, in particular longitudinally movably, in the conveying cylinder in order to in particular directly take in construction material and/or thick matter into the conveying cylinder and in order to in particular directly displace taken-in construction material and/or thick matter out of the conveying cylinder. The method comprises or has the steps: Conveying, in particular automatically conveying, construction material and/or thick matter by in particular automatic and/or cyclic movement of the conveying piston in order to take in and displace construction material and/or thick matter. Detecting, in particular automatically detecting, at least one position variable, in particular at least one value of the position variable, during the movement. The position variable, in particular the value of the position variable, characterizes a position, in particular a value of the position, of the conveying piston along its stroke in the conveying cylinder. Detecting, in particular automatically detecting, at least one conveying variable, in particular at least one value of the conveying variable, during the movement. The conveying variable, in particular the value of the conveying variable, is distinct from the position variable and characterizes the conveying, in particular a value of the conveying, of construction material and/or thick matter by means of the construction material and/or thick matter pump. Determining, in particular automatically determining, or setting or adapting, an in particular chronological profile of an in particular chronologically subsequent movement of the conveying piston by linking, in particular at least, the detected position variable, in particular the detected value of the position variable, and the detected conveying variable, in particular the detected value of the conveying variable, with one another. At least controlling, in particular automatically controlling in open-loop and/or closed-loop fashion, the subsequent movement in accordance with the determined profile.

This, in particular the linking, allows adaptive and thus optimum operation of the construction material and/or thick matter pump. In particular, this can allow optimum conveying of construction material and/or thick matter by means of the construction material and/or thick matter pump.

Construction material may refer in particular to mortar, cement, screed, concrete and/or plaster. Additionally or alternatively, thick matter may refer to sludge.

The construction material and/or thick matter pump may have at least one drive cylinder, at least one drive piston and at least one piston rod. The drive cylinder may be configured to in particular directly receive hydraulic liquid, in particular hydraulic oil. The drive piston may be arranged movably, in particular longitudinally movably, in the drive cylinder. The piston rod may be fastened to the drive piston, and in particular to the conveying piston, for in particular direct movement coupling with the conveying piston.

The position variable may be a, in particular the, position of the conveying piston, of the piston rod or of the drive piston, if present. Additionally or alternatively, the position variable may characterize at least one stroke end position of the conveying piston at at least one end of the stroke in the conveying cylinder.

"Along its stroke" may mean between, in particular the, stroke end positions of the conveying piston at, in particular the, ends of the stroke in the conveying cylinder. Additionally or alternatively, one stroke end position may be an intake end position, and/or one, in particular different, stroke end position may be a displacement end position, which in particular differs from the intake end position.

"Characterizing" may be referred to as "representative of".

"Detection" may be referred to as "measurement".

The position variable and the conveying variable may be detected simultaneously, in particular continuously over time.

An in particular chronological course of the position variable can be detected. Additionally or alternatively, an in particular chronological course of the conveying variable may be detected. Additionally, the profile may be determined by linking the detected course of the position variable and the detected course of the conveying variable with one another.

The position variable or its value, and/or the conveying variable or its value, may in particular each vary in stepless, in particular continuous fashion. Additionally or alternatively, the position variable and/or the conveying variable may in particular each be an in particular absolute unit of measurement or a relative unit, in particular in percent (%), in particular bounded by a minimum value of 0% and a maximum value of 100%, in particular between the minimum value or 0% and the maximum value or 100%.

"Distinct" may mean that the position variable and the conveying variable do not need to, or may not, have an in particular fixed relationship, in particular a relationship which is fixed over multiple movement strokes and/or cycles, and/or may be independent of one another. In other words, "distinct" may mean that the conveying variable does not need to, or may not, be an in particular fixed function, in particular a function that is fixed over multiple movement strokes and/or cycles, of the position variable.

The position variable and/or the conveying variable may in particular each be linked in an, in particular mathematically, unprocessed or processed form.

"Linking" may be referred to as "correlating" and/or "amalgamating".

The profile may assign different positions of the conveying piston, in particular along its stroke, to different points in time and/or different speeds of the conveying piston. Additionally or alternatively, the profile may assign different points in time to different positions, in particular speeds, of the conveying piston, in particular along its stroke.

The construction material and/or thick matter pump may have at least one drive motor device and/or at least one drive pump device for in particular indirectly moving the conveying piston. In particular, the drive motor device and/or the drive pump device may be controlled in accordance with the determined profile.

The profile may be determined and/or at least controlled in open-loop fashion, in particular controlled in closed-loop fashion, at a time after or at an end of the stroke and/or of the movement, in particular stroke or cycle, and/or at a time before or at a start of a subsequent stroke and/or of a subsequent movement, in particular of a subsequent or cycle, and in particular not in particular chronologically before the end of the stroke and/or not in particular chronologically after the start of the subsequent stroke and/or during an adjustment of a line switch, and/or when the conveying piston may be, or may be at a standstill, in one of the stroke end positions. In other words, the determined profile may be controlled in open-loop fashion, in particular controlled in closed-loop fashion, or followed, during the stroke and/or the movement, in particular the movement stroke or cycle, in steady-state, in particular quasi-steady-state, fashion or without alteration or without adaptation, in particular during the stroke and/or the movement.

In one refinement of the invention, the conveying variable, in particular the value of the conveying variable, characterizes an introduction, in particular a value of the introduction, of energy from the conveying piston into construction material and/or thick matter. This makes it possible to determine the profile such that an amount of energy that is introduced from the conveying piston into construction material and/or thick matter per unit of time is not excessive. This makes it possible for the construction material and/or thick matter pump to be operated with low load and/or reliably. In particular, the conveying variable may be the introduction of energy. Additionally or alternatively, the conveying variable may be an in particular acting torque of the drive motor device, if present.

In one embodiment of the invention, the conveying variable, in particular the value of the conveying variable, characterizes a pressure, in particular a value of the pressure, acting on construction material and/or thick matter in the conveying cylinder. Additionally or alternatively, the conveying variable, in particular the value of the conveying variable, characterizes an excitation, in particular a value of the excitation, of at least one part of the construction material and/or thick matter pump caused by the introduction of energy from the conveying piston into construction material and/or thick matter. This makes it possible to determine the profile such that an increase or a decrease of the pressure per unit of time is not excessive. Additionally or alternatively, this makes it possible for an excitation of the part not to be excessive. In particular, the conveying variable may be a pressure, in particular a drive and/or high pressure, acting on the conveying piston, the piston rod or the drive piston of the drive pump device, if present. Further additionally or alternatively, the conveying variable may characterize an excitation, an acceleration and/or a rate of rotation of the part. Further additionally or alternatively, "excitation" may be referred to as "vibration" or "resonance". Further additionally or alternatively, the part may be a conveying line or a conveying or distributor boom.

In one embodiment of the invention, the method comprises or has: Determining, in particular automatically determining, or ascertaining a displacement start position, in particular a value of the displacement start position, wherein the conveying piston starts to displace taken-in construction material and/or thick matter out of the conveying cylinder at the displacement start position, by linking the detected position variable, in particular the detected value of the position variable, during the movement for the displacement, in particular during the displacement, or to the determining displacement start position, and the detected conveying variable, in particular the detected value of the conveying variable that characterizes the introduction of energy from the conveying piston into construction material and/or thick matter during the movement for the displacement, in particular during the displacement, or to the determining displacement start position, with one another. Determining the profile on the basis of the determined displacement start position, in particular the determined value of the displacement start position. In particular, the profile of an in particular chronologically subsequent movement for the intake, in particular of a subsequent intake, may be determined such that the displacement start position is reached as close as possible to, and in particular thus optimally close to, an, in particular the, intake or stroke end position. Additionally or alternatively, the displacement start position may be determined by linking the detected course of the position variable and the detected course of the conveying variable with one another. Further additionally or alternatively, the displacement start position may be determined as the position of the conveying piston at which the conveying variable, in particular the introduction of energy and/or pressure and/or the excitation, if present, and/or a chronological increase thereof, reaches or overshoots an in particular specified limit value.

In one embodiment of the invention, the method comprises or has: Determining, in particular automatically determining, or ascertaining, a degree of filling, in particular a value of the degree of filling, of the conveying cylinder with construction material and/or thick matter on the basis of the determined displacement start position, in particular the determined value of the displacement start position, and in particular a geometry of the conveying cylinder. Determining a profile of an in particular chronologically subsequent movement for the intake, in particular of a subsequent intake, on the basis of the determined degree of filling, in particular the determined value of the degree of filling. Controlling the subsequent movement for the intake, in particular controlling the subsequent intake, in accordance with the determined profile. In particular, the profile may be determined such that a maximum, and in particular thus optimum, degree of filling is achieved. In particular, this may be achieved by virtue of a displacement start position being reached as close as possible to the intake or stroke end position. Additionally or alternatively, the displacement start position may characterize the degree of filling.

In one embodiment of the invention, the method comprises or has: Ascertaining, in particular automatically ascertaining, in particular detecting, a duration, in particular a value of the duration, for an in particular chronologically preceding movement for the intake, in particular of a preceding intake, causing the determined displacement start position, in particular the determined value of the displacement start position, and/or the determined degree of filling, in particular the determined value of the degree of filling. Determining, in particular automatically determining, or ascertaining, a conveying rate, in particular a value of the conveying rate, by linking the determined displacement start position, in particular the determined value of the displacement start position, and/or the determined degree of filling, in particular the determined value of the degree of filling, and the ascertained duration, in particular the ascertained value of the duration, with one another. Determining the profile of a, in particular the, subsequent movement for the intake, in particular of a, in particular the, subsequent intake, on the basis of the determined conveying rate, in particular the determined value of the conveying rate. In particular, the profile may be determined such that a maximum, and in particular thus optimum, conveying rate is achieved. In particular, this may be achieved by virtue of a displacement start position being reached as close as possible to the intake or stroke end position and/or by achieving a high degree of filling and a short duration. Additionally or alternatively, the displacement start position and/or the degree of filling and the duration may characterize the conveying rate. Further additionally or alternatively, "conveying rate" can be referred to as "conveying volume flow".

In one embodiment of the invention, the method comprises or has: Decreasing, in particular automatically decreasing, a speed, in particular a value of the speed, and/or increasing a standstill duration, in particular a value of the standstill duration, of the profile, in particular of the conveying piston, from an in particular chronologically preceding intake to an in particular chronologically subsequent intake until the displacement start position, in particular a value of the displacement start position, no longer approaches a, in particular the, intake or stroke end position, in particular a value of the intake or stroke end position, and/or the fill level, in particular the value of the fill level, and/or the conveying rate, in particular the value of the conveying rate, no longer increase(s). Additionally or alternatively increasing, in particular automatically increasing, a speed, in particular a value of the speed, and/or decreasing a standstill duration, in particular a value of the standstill duration, of the profile, in particular of the conveying piston, from an in particular chronologically preceding intake to an in particular in particular chronologically subsequent intake, until the displacement start position, in particular a value of the displacement start position, moves away from an, in particular the, intake or stroke end position, in particular a value of the intake or stroke end position, and/or the rear filling, in particular the value of the degree of filling, and/or the conveying rate, in particular the value of the conveying rate, decrease(s). This makes it possible to achieve a displacement start position as close as possible to the intake or stroke end position and/or the maximum degree of filling and/or the maximum conveying rate. In particular, if the displacement start position no longer approaches the intake or stroke end position and/or the degree of filling and/or the conveying rate no longer increase(s), the speed may be increased to a value of the profile of the preceding intake, and/or the standstill duration may be reduced to a value of the profile of the preceding intake. Additionally or alternatively, if the displacement start position moves away from the intake or stroke end position and/or the degree of filling and/or the conveying rate decrease(s), the speed may be decreased to a value of the profile of the preceding intake and/or the standstill duration may be increased to a value of the profile of the preceding intake. Further additionally or alternatively, the standstill duration may be at or for the intake or stroke end position.

In one refinement of the invention, the method comprises or has: Determining the profile of an in particular chronologically subsequent movement, in particular from a, in particular the, intake or stroke end position, in particular a value of the intake or stroke end position, to a, in particular new or the, displacement start position, in particular a value of the displacement start position, on the basis of the determined displacement start position, in particular the determined value of the displacement start position. Controlling the subsequent movement to the displacement start position in accordance with the determined profile. In particular, the profile may be determined such that an excitation, in particular a value of the excitation, of at least one part of the construction material and/or thick matter pump caused by the introduction of energy from the conveying piston into construction material and/or thick matter is reduced or even prevented, in particular such that the conveying piston does not move against the construction material and/or thick matter at too high a speed. This makes it possible for the construction material and/or thick matter pump to be operated with low load and/or low excitation and/or in a reliable manner. In particular, this is by contrast to a speed and/or acceleration ramp that is fixedly specified over several movement strokes and/or cycles.

In one embodiment of the invention, the method comprises or has: determining the profile such that the conveying piston accelerates, in particular from the intake or stroke end position, in particular the value of the intake or stroke end position, and in particular chronologically subsequently decelerates before the displacement start position, in particular the value of the displacement start position. This makes it possible for the displacement start position to be reached with a minimum duration, without the conveying piston moving against the construction material and/or thick matter at too high a speed.

In one embodiment of the invention, the method comprises or has: Ascertaining, in particular automatically ascertaining, in particular detecting, a duration, in particular a value of the duration, for an in particular chronologically preceding movement for the intake and/or for the determined subsequent movement for the intake and/or for an in particular chronologically preceding movement to the displacement start position, in particular the value of the displacement start position, and/or for the determined subsequent movement to the displacement start position, in particular the value of the displacement start position. Determining, in particular automatically determining, or ascertaining, a remaining duration, in particular a value of the remaining duration, for an in particular chronologically subsequent movement for the displacement, in particular of a subsequent displacement, and/or to a displacement end position, in particular a value of the displacement end position, by linking the ascertained duration, in particular the ascertained value of the duration, and the specified cycle and/or stroke duration, in particular a specified value of the cycle and/or stroke duration, and/or a specified conveying rate, in particular a specified value of the conveying rate, with one another. Determining the profile of the subsequent movement for the displacement, in particular of the subsequent displacement, in particular to a, in particular the, displacement or stroke end position, on the basis of the determined remaining duration, in particular the determined value of the remaining duration. Controlling the subsequent movement for the displacement, in particular controlling the subsequent displacement, in accordance with the determined profile. In particular, the profile may be determined such that the remaining duration is attained, and thus the cycle and/or stroke duration and/or the conveying rate are/is attained. Additionally or alternatively, the cycle duration and/or stroke duration and/or the conveying rate may be or have been specified by a user. Further additionally or alternatively, "conveying rate" may be referred to as "conveying volume flow". Further additionally or alternatively, the profile may be determined taking into consideration a deceleration of the conveying piston, in particular after the displacement start position and before the displacement or stroke end position.

In one embodiment of the invention, the method comprises or has: determining the profile of an in particular chronologically subsequent movement for the displacement, in particular of a subsequent displacement, in particular to a, in particular the, displacement or stroke end position, by linking the detected position variable, in particular the detected value of the position variable, during the movement for the displacement, in particular of the displacement, and the detected conveying variable, in particular the detected value of the conveying variable, which characterizes the introduction of energy from the conveying piston into construction material and/or thick matter during the movement for the displacement, in particular during the displacement, with one another such that an excitation, in particular a value of the excitation, of at least one part of the construction material and/or thick matter pump caused by the introduction of energy from the conveying piston into construction material and/or thick matter is reduced or even prevented. Controlling the subsequent movement for the displacement, in particular controlling the subsequent displacement, in accordance with the determined profile. This makes it possible for the construction material and/or thick matter pump to be operated with low load and/or in a reliable manner. In particular, the method may comprise: decreasing or increasing a speed of the profile, in particular of the conveying piston, from an in particular preceding, and/or the, displacement to a, in particular the, subsequent displacement such that an excitation at least of the part is reduced or prevented. Additionally or alternatively, "excitation" may be referred to as "vibration" or "resonance". Further additionally or alternatively, the part may be a conveying line or a conveying or distributor boom.

In one refinement of the invention, construction material and/or thick matter pump comprises or has a, in particular the, adjustable line switch. The conveying variable, in particular the value of the conveying variable, characterizes a position, in particular a value of the position, of the line switch. This makes it possible for the construction material and/or thick matter pump to be operated with low wear and/or without problems, and/or for construction material and/or thick matter to be conveyed by means of the construction material and/or thick matter pump with the least possible interruption, and in particular thus in an optimum manner. In particular, the construction material and/or thick matter pump may have an actuating system for adjusting the line switch. Further additionally or alternatively, the conveying variable may be a, in particular the, position of the line switch or of the actuating system, if present. Additionally or alternatively, the line switch may be referred to as a gate valve system. Further additionally or alternatively, the line switch may have, in particular be, a pipe switch, in particular a S-shaped pipe. Further additionally or alternatively, the construction material and/or thick matter pump may have a, in particular the, conveying line and a construction material and/or thick matter supply, in particular a supply hopper. The line switch may be designed to connect the conveying cylinder in particular either to the conveying line in one position, or the construction material and/or thick matter supply in another position, for a flow of construction material and/or thick matter.

In one embodiment of the invention, the method comprises or has: Determining the profile of an in particular chronologically subsequent movement for the displacement to a, in particular the, displacement or stroke end position, in particular a value of the displacement or stroke end position, and/or or the intake from the displacement or stroke end position, in particular of the value of the displacement or stroke end position, and/or for the intake to a, in particular the, intake or stroke end position, in particular of a value of the intake or stroke end position, and/or for the displacement from the intake or stroke end position, in particular of the value of the intake or stroke end position, by linking the detected position variable, in particular the detected value of the position variable, and the detected conveying variable, in particular the detected value of the conveying variable, which characterizes the position of the line switch with one another such that the subsequent movement of the conveying piston and an in particular subsequent adjustment of the line switch are or have been synchronized. Controlling the subsequent movement to the displacement end position and/or from the displacement end position and/or to the intake end position and/or from the intake end position in accordance with the determined profile. In particular, the profile may be determined such that the conveying piston is, or is at a standstill, in the displacement or stroke end position and/or the intake or stroke end position exactly when the adjustment of the line switch starts, and/or accelerates from said position exactly when the adjustment of the line switch has ended. This can make it possible for the construction material and/or thick matter pump to be operated with low wear and thus in particular without problems, and/or for of construction material and/or thick matter to be conveyed by means of the construction material and/or thick matter pump with the least possible interruption, and in particular thus in an optimum manner.

In one refinement of the invention, the method comprises or has the step: Selecting in particular only one single optimization target from a set of several selectable optimization targets, said selection being performed in particular by a user. The method comprises or has: Determining, in particular automatically determining, the profile in accordance with the selected optimization target. In particular, the profile may be determined such that the selected optimization target is achieved. Further additionally or alternatively, the optimization targets may be:

operating the construction material and/or thick matter pump with low load and/or low excitation and/or in a reliable manner and/or with low wear and/or without problems, in particular not introducing an excessive amount of energy from the conveying piston into construction material and/or thick matter per unit of time, a non-excessive increase or a non-excessive decrease of the pressure per unit of time, an, in particular non-excessive, excitation of the part, and/or reduce or prevent, reaching the displacement start position in a minimum duration, without the conveying piston moving against the construction material and/or thick matter at too high a speed, a displacement start position as close as possible to the intake or stroke end position, a maximum degree of filling, a maximum conveying rate, attaining the remaining duration and/or the cycle and/or stroke duration and/or the conveying rate, synchronized movement of the conveying piston and adjusting the line switch, and conveying construction material and/or thick matter by means of the construction material and/or thick matter pump with the least possible interruption.

Further additionally or alternatively, the optimization targets may differ and/or may be achieved non-simultaneously or achievable non-simultaneously and/or may be non-combinable with one another, or may be mutually contradictory. Further additionally or alternatively, the optimization target may be selected by specification, in particular inputting, of the optimization target, for example of the conveying rate. Further additionally or alternatively, the construction material and/or thick matter pump may have a user-actuatable operator control element for the selection of the optimization target.

The construction material and/or thick matter pump according to the invention is designed or configured for in particular automatically conveying construction material and/or thick matter, in particular for carrying out a method as described above. The construction material and/or thick matter pump comprises or has, in particular the, at least one conveying cylinder, in particular the, at least one conveying piston, at least one in particular electrical travel sensor device, at least one in particular electrical conveying sensor device, an in particular electrical determining device, and an in particular electrical control device, in particular closed-loop control device. The conveying cylinder is designed or configured to receive and discharge construction material and/or thick matter. The conveying piston is arranged movably in the conveying cylinder in order to take in construction material and/or thick matter into the conveying cylinder and in order to displace taken-in construction material and/or thick matter out of the conveying cylinder. The construction material and/or thick matter pump is designed or configured to in particular automatically convey construction material and/or thick matter by in particular automatic movement of the conveying piston in order to take in and displace construction material and/or thick matter. The travel sensor is designed or configured to in particular automatically detect at least one, in particular the at least one, position variable during the movement. The position variable characterizes a, in particular the, position of the conveying piston along its stroke in the conveying cylinder. The conveying sensor device differs from the travel sensor device and is designed or configured to in particular automatically detect at least one, in particular the at least one, conveying variable during the movement. The conveying variable is distinct from the position variable and characterizes the conveying of construction material and/or thick matter by means of the construction material and/or thick matter pump. The determining device is designed or configured to in particular automatically determine a, in particular the, profile of a, in particular the, subsequent movement of the conveying piston by linking the detected position variable and the detected conveying variable with one another. The control device is designed or configured to in particular automatically control, in particular in closed-loop fashion, the subsequent movement in accordance with the determined profile.

The construction material and/or thick matter pump may make the same advantage as possible as the above-described method.

In particular, the construction material and/or thick matter pump may be configured at least partially or entirely as described above for the method.

The travel sensor device may be referred to as a travel measurement system, travel transducer device, spacing sensor device, position sensor device or distance sensor device. In particular, the travel sensor device need not, or may not, be a proximity switch device.

The determining device and/or the control device may in particular each have a processor and/or a memory.

Further advantages and aspects of the invention will emerge from the claims and from the following description of preferred exemplary embodiment of the invention, which are discussed below on the basis of the figures.

DETAILED DESCRIPTION OF THE EXEMPLARY EMBODIMENTS

Figure 1:
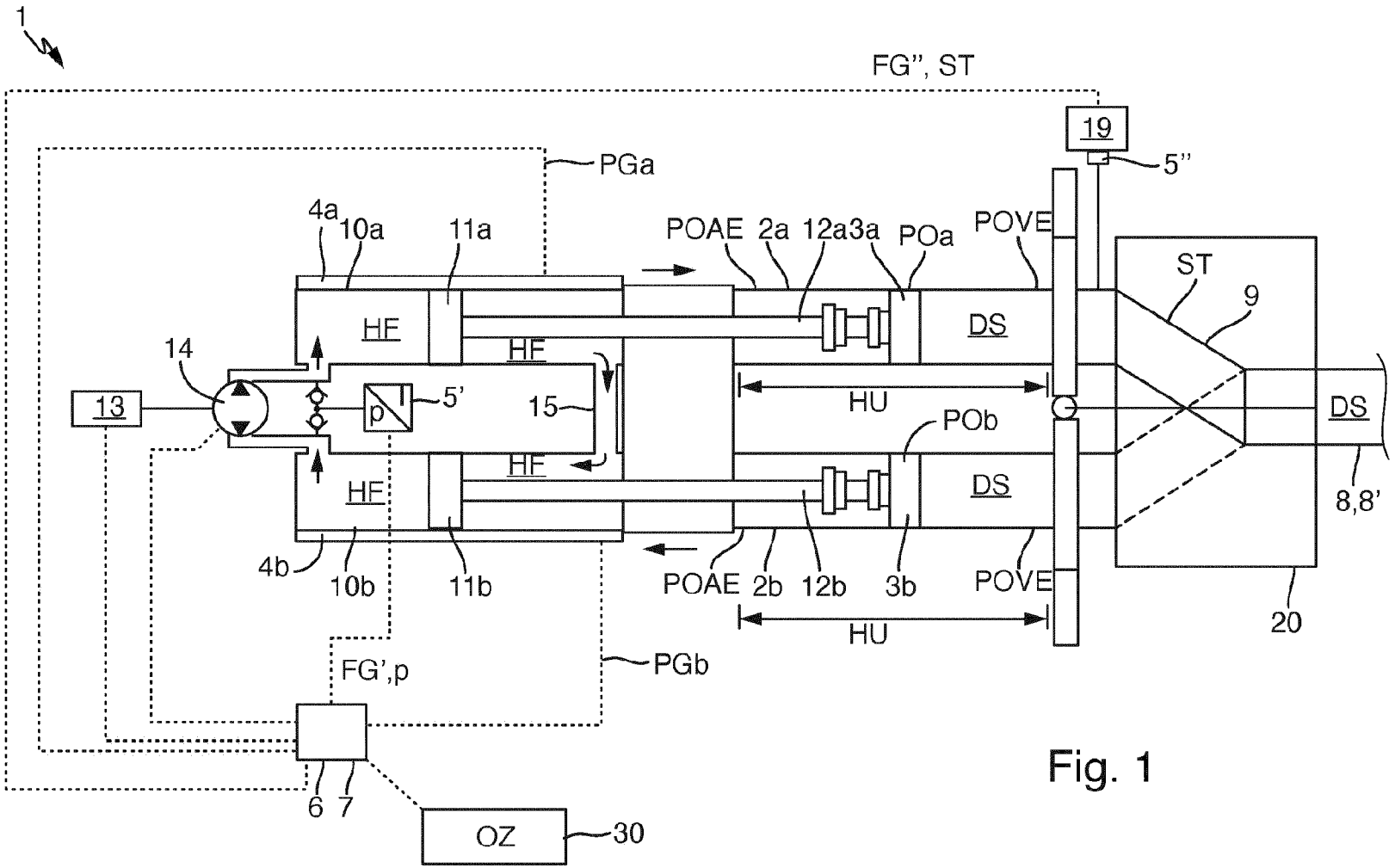
FIG. 1 shows a schematic circuit diagram of a construction material and/or thick matter pump according to the invention for conveying construction material and/or thick matter.
Figure 2:
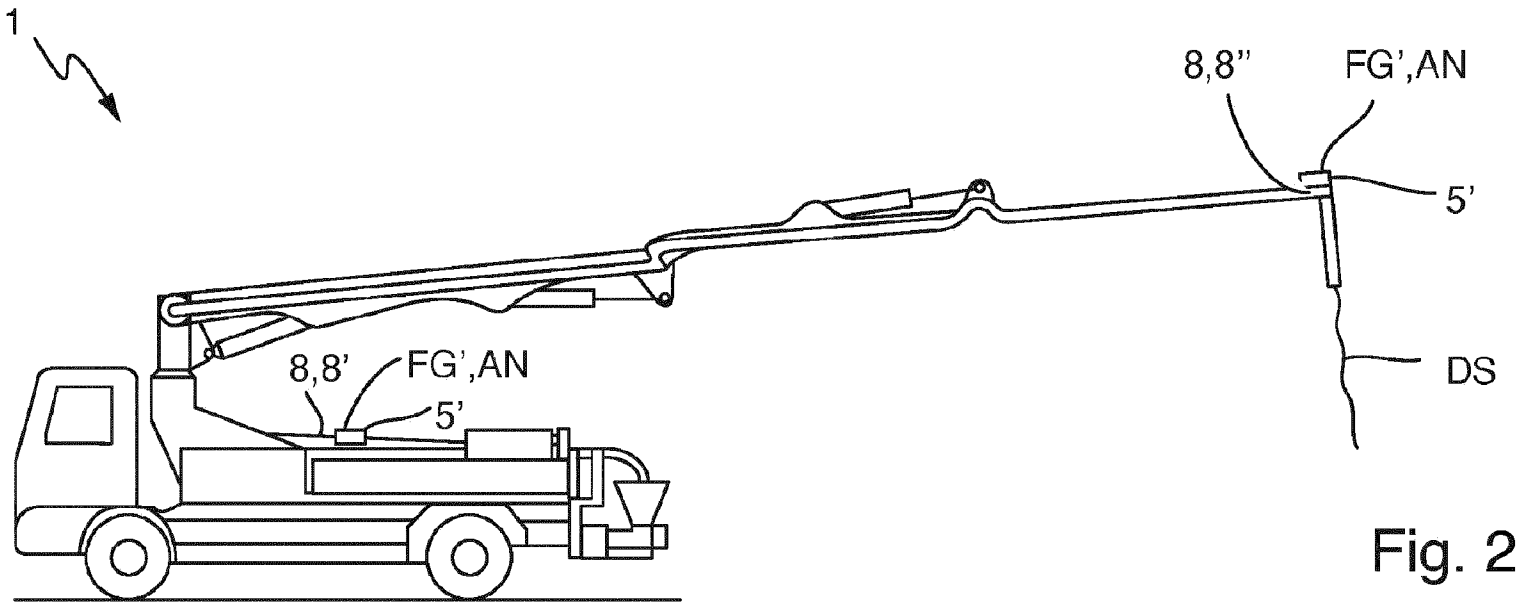
FIG. 2 shows a schematic view of the construction material and/or thick matter pump of FIG. 1.

FIGS. 1 and 2 show a construction material and/or thick matter pump 1 for conveying construction material and/or thick matter DS. The construction material and/or thick matter pump has at least one conveying cylinder 2*a*, 2*b*, at least one conveying piston 3*a*, 3*b*, at least one travel sensor device 4*a*, 4*b*, at least one conveying sensor device 5', 5", a determining device 6, and a control device 7. The conveying cylinder 2*a*, 2*b* is configured to receive and discharge construction material and/or thick matter DS. The conveying piston 3*a*, 3*b* is arranged movably in the conveying cylinder 2*a*, 2*b* in order to take in construction material and/or thick matter DS into the conveying cylinder 2*a*, 2*b* and in order to displace taken-in construction material and/or thick matter DS out of the conveying cylinder 2*a*, 2*b*. The construction material and/or thick matter pump 1 is configured to convey construction material and/or thick matter DS by the conveying piston 3*a*, 3*b* in order to take in and displace construction material and/or thick matter DS. The travel sensor device 4*a*, 4*b* is configured to detect at least one position variable PGa, PGb during the movement. The position variable PGa, PGb characterizes a position PGa, PGb of the conveying piston 3*a*, 3*b* along its stroke HU in the conveying cylinder 2*a*, 2*b*. Conveying sensor device 5', 5" differs from the travel sensor device 4*a*, 4*b*. The conveying sensor device 5', 5" is furthermore configured to detect at least one conveying variable FG', FG" during the movement. The conveying variable FG', FG" is distinct from the position variable PGa, PGb. Furthermore, the conveying variable FG', FG" characterizes the conveying of construction material and/or thick matter DS by means of the construction material and/or thick matter pump 1. The determining device 6 is configured to determine a profile PR of a subsequent movement of the conveying piston 3*a*, 3*b* by linking the detected position variable PGa, PGb and the detected conveying variable FG', FG" with one another. The control device 7 is configured at least to control the subsequent movement in accordance with the determined profile PR.

FIGS. 1 to 4 and 6 show a method for operating the construction material and/or thick matter pump 1 for conveying construction material and/or thick matter DS. The construction material and/or thick matter pump 1 has the at least one conveying cylinder 2*a*, 2*b* and the at least one conveying piston 3*a*, 3*b*. The conveying cylinder 2*a*, 2*b* is configured to receive and discharge, in particular receives and discharges, construction material and/or thick matter DS. The conveying piston 3*a*, 3*b* is arranged movably in the conveying cylinder 2*a*, 2*b* in order to take in construction material and/or thick matter DS into the conveying cylinder 2*a*, 2*b* and in order to displace taken-in construction material and/or thick matter DS out of the conveying cylinder 2*a*, 2*b*. The method has the steps: Conveying construction material and/or thick matter DS by movement of the conveying piston 3*a*, 3*b* in order to take in and displace construction material and/or thick matter. Detecting the at least one position variable PGa, PGb during the movement, in particular by means of the at least one travel sensor device 4*a*, 4*b*. The position variable PGa, PGb characterizes the position POa, POb of the conveying piston 3*a*, 3*b* along its stroke HU in the conveying cylinder 2*a*, 2*b*. Detecting the at least one conveying variable FG', FG" during the movement, in particular by means of the at least one conveying sensor device 5', 5". The conveying variable FG', FG" is distinct from the position variable PGa, PGb. Furthermore, the conveying variable FG', FG" characterizes the conveying of construction material and/or thick matter DS by means of the construction material and/or thick matter pump 1. Determining the profile PR of the subsequent movement of the conveying piston 3*a*, 3*b* by linking the detected position variable PGa, PGb and the detected conveying variable FG', FG" with one another, in particular by means of the determining device 6. At least controlling the subsequent movement in accordance with the determined profile PR, in particular by means of the control device 7.

In the exemplary embodiment shown, the construction material and/or thick matter pump 1 has at least one drive cylinder 10*a*, 10*b*, at least one drive piston 11*a*, 11*b* and at least one piston rod 12*a*, 12*b*. The drive cylinder 10*a*, 10*b* is configured to receive, in particular receives, hydraulic liquid HF. The drive piston 11*a*, 11*b* is arranged movably in the drive cylinder 10*a*, 10*b*. The piston rod 12*a*, 12*b* is fastened to the drive piston 11*a*, 11*b* for movement coupling with the conveying piston 3*a*, 3*b*.

Furthermore, in the exemplary embodiment shown, the position variable PGa, PGb is a position of the drive piston 11*a*, 11*b*. In alternative exemplary embodiments, the position variable may be a, in particular the, position of the conveying piston or of the piston rod.

Furthermore, in the exemplary embodiment shown, the construction material and/or thick matter pump 1 has at least one drive motor device 13 and at least one drive pump device 14 for moving the conveying piston 3*a*, 3*b*, in particular move.

In detail, the drive motor device 13 is configured to drive or move, in particular drives or moves, the drive pump device 14. Furthermore, the drive pump device 14 is configured to pump or move, in particular pumps or moves, hydraulic liquid HF with a pressure, in particular a drive pressure, p, and is thus configured to move, in particular moves, the drive piston 11*a*, 11*b*, in particular in the drive cylinder 10*a*, 10*b*, and is thus configured to move, in particular moves, the piston rod 12*a*, 12*b*, and is thus configured to move, in particular moves, the conveying piston 3*a*, 3*b*.

Figure 3:
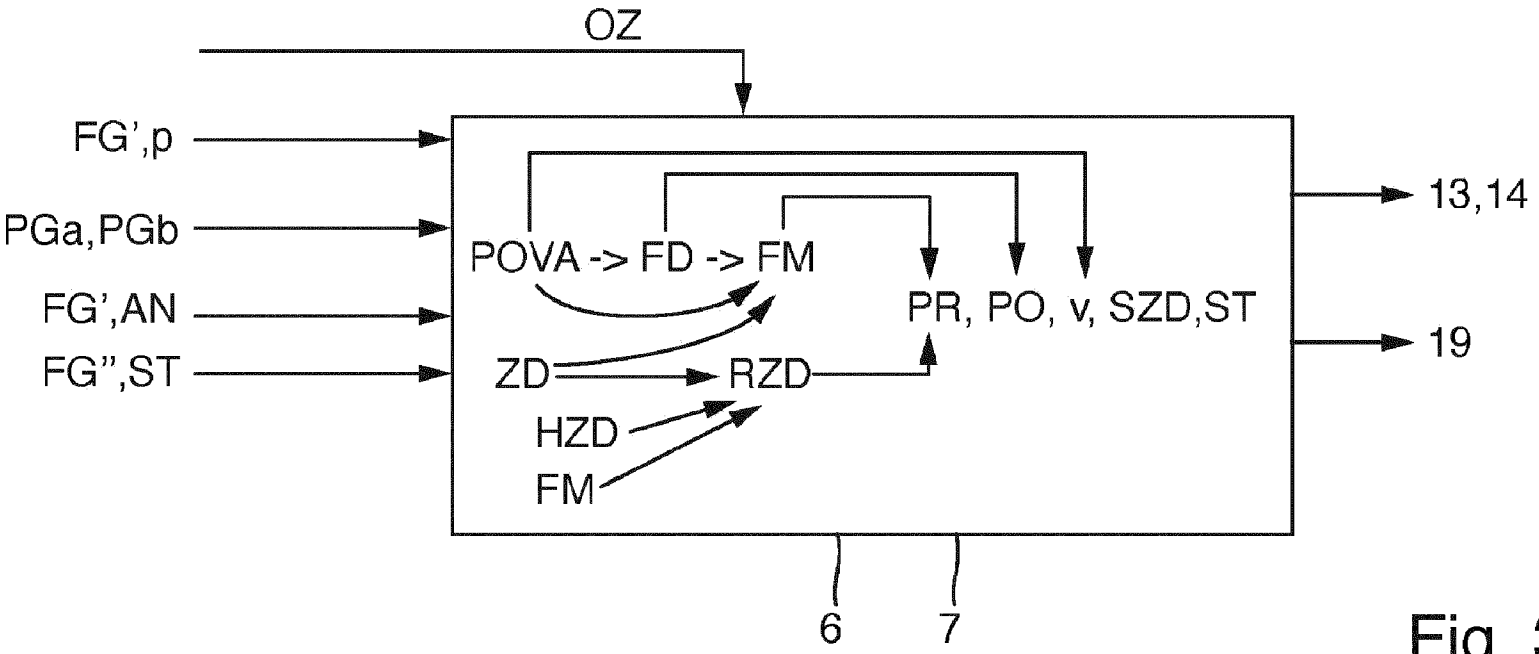
FIG. 3 shows a flow diagram of a method according to the invention for operating the construction material and/or thick matter pump of FIG. 1 for conveying construction material and/or thick matter.

Furthermore, the control device 7 is configured to control, in particular controls, the drive motor device 13 and the drive pump device 14 in order to control the subsequent movement in accordance with the determined profile, as shown in FIG. 3.

In the exemplary embodiment shown, the construction material and/or thick matter pump 1 has, in particular exactly, two conveying cylinders 2*a*, 2*b*, in particular exactly, two conveying pistons 3*a*, 3*b* and, in particular exactly, two travel sensor devices 4*a*, 4*b*, and in particular, in particular exactly, two drive cylinders 10*a*, 10*b*, in particular exactly, two drive pistons 11*a*, 11*b* and, in particular exactly, two piston rods 12*a*, 12*b*. In alternative exemplary embodiments, the construction material and/or thick matter pump may have only a single conveying cylinder, only a single conveying piston and only a single travel sensor device, and in particular only a single drive cylinder, only a single drive piston and only a single piston rod, or at least three conveying cylinders, at least three conveying pistons and at least three travel sensor devices, and in particular at least three drive cylinders, at least three drive pistons and at least three piston rods.

Furthermore, in the exemplary embodiment shown, the construction material and/or thick matter pump 1 has an oscillation line 15 for hydraulic liquid HF. The drive pump device 14 and the drive cylinders 10*a*, 10*b* form, via the oscillation line 15, a drive circuit for hydraulic liquid HF. In other words: the drive cylinders 10*a*, 10*b* are connected by means of the oscillation line 15 for a flow of hydraulic liquid HF, in particular between the drive cylinders 10*a*, 10*b*. By means of the oscillation line 15, the drive pistons 11*a*, 11*b* and thus the piston rods 12*a*, 12*b* and thus the conveying pistons 3*a*, 3*b* are coupled to one another at least temporarily, in particular continuously over time, in particular in antiphase, in particular in 180-degree antiphase, or for opposite movement.

In FIG. 1, the drive piston 11*a* moves, and the piston rod 12*a* thus moves, and the conveying piston 3*a* thus moves, to the right as indicated by an arrow. Hydraulic liquid HF flows from the drive cylinder 10*a* through the oscillation line 15 to the drive cylinder 10*b*, as shown by an arrow. The drive piston 11*b* thus moves, and the piston rod 12*b* thus moves, and the conveying piston 3*b* thus moves, to the left as indicated by an arrow. When the conveying pistons 3*a*, 3*b*, and in particular the drive pistons 11*a*, 11*b*, have reached their in particular respective stroke end positions POAE, POVE, the movement directions are interchanged. The drive piston 11*a* thus moves, and the piston rod 12*a* thus moves, and the conveying piston 3*a* thus moves, to the left, and the drive piston 11*b* moves, and the piston rod 12*b* thus moves, and the conveying piston 3*b* thus moves, to the right.

In particular, the construction material and/or thick matter pump a have an infeed point and/or an outfeed point for the infeed and/or outfeed of hydraulic liquid into the oscillation line. This can allow the drive piston and thus the piston rods and thus the conveying pistons to be temporarily not coupled to one another, or to be temporarily decoupled from one another, in particular for independent movement.

The construction material and/or thick matter pump 1 furthermore has an adjustable line switch 9.

In the exemplary embodiment shown, the construction material and/or thick matter pump 1 has a conveying line 8' and a construction material and/or thick matter supply 20. The line switch 9 is configured to connect, in particular connects, the conveying cylinder 2*a*, 2*b* in particular either to the conveying line 8', in one position, or to the construction material and/or thick matter supply 20, in another position, for a flow of construction material and/or thick matter DS.

In FIG. 1, the line switch 9 connects the conveying cylinder 2*a* to the conveying line 8' and connects the conveying cylinder 2*b* to the construction material and/or thick matter supply 20.

Furthermore, the conveying piston 3*b* takes construction material and/or thick matter DS into the conveying cylinder 2*b*, in particular from the in particular connected construction material and/or thick matter supply 20. The conveying piston 3*a*, in particular at the same time, displaces taken-in construction material and/or thick matter DS out of the conveying cylinder 2*a*, in particular into the in particular connected conveying line 8'.

When the conveying pistons 3*a*, 3*b* have reached their in particular respective stroke end positions POAE, POVE, the line switch 9 is adjusted, in particular by means of the control device 7. The line switch 9 thus connects the conveying cylinder 2*b* to the conveying line 8' and connects the conveying cylinder 2*a* to the construction material and/or thick matter supply 20. The conveying piston 3*a* thus takes construction material and/or thick matter DS into the conveying cylinder 2*a*, in particular from the in particular connected construction material and/or thick matter supply 20. The conveying piston 3*b*, in particular at the same time, displaces taken-in construction material and/or thick matter DS out of the conveying cylinder 2*b*, in particular into the in particular connected conveying line 8'.

Furthermore, the exemplary embodiment shown, the construction material and/or thick matter pump 1 is configured as a mobile construction material and/or thick matter pump, in particular as a truck-mounted construction material and/or thick matter pump, as shown in FIG. 2.

Furthermore, the conveying variable FG' characterizes an introduction of energy from the conveying piston 3*a*, 3*b* into construction material and/or thick matter DS.

Figure 4:
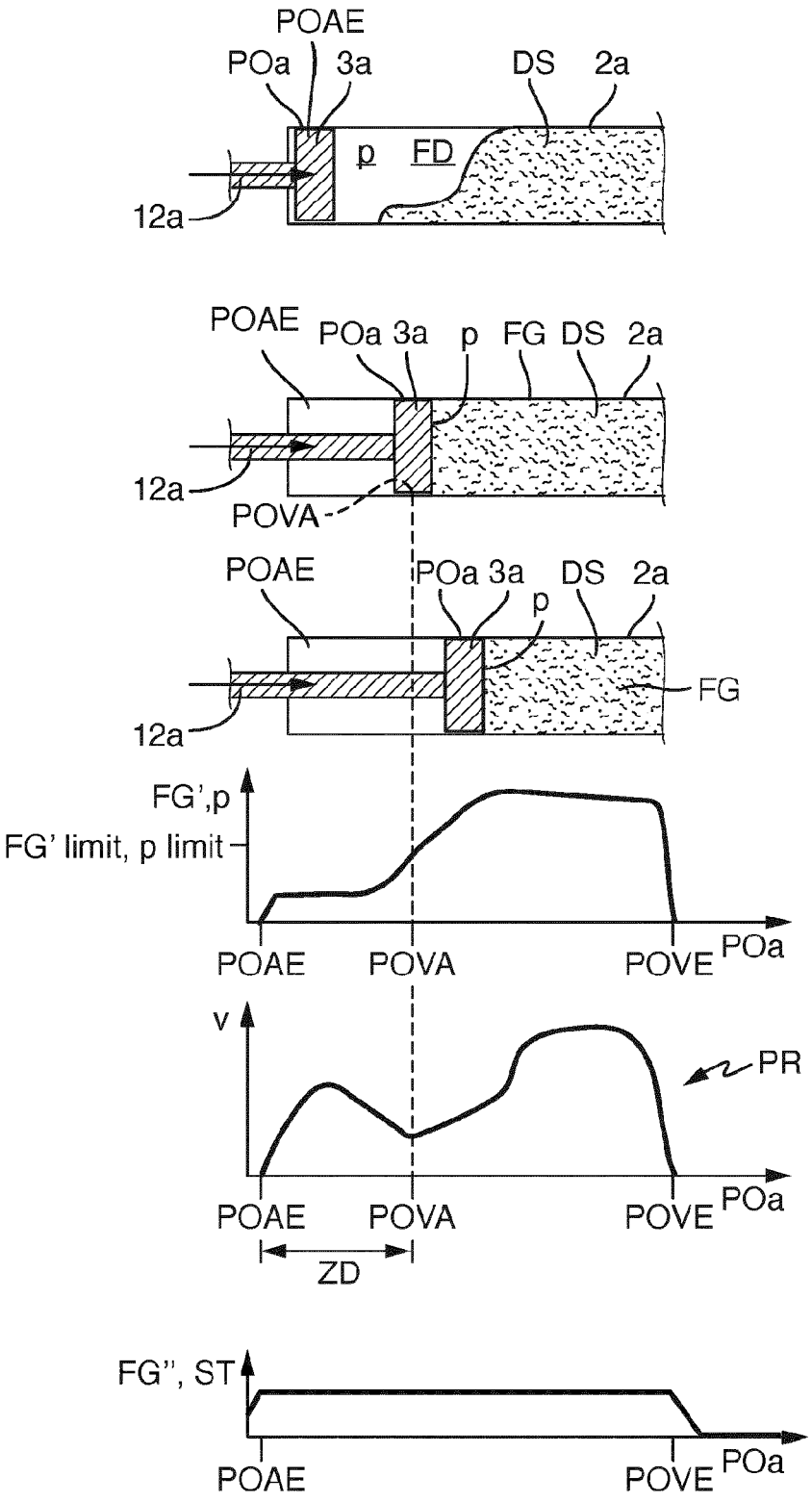
FIG. 4 shows a schematic view of a movement of a conveying piston in a conveying cylinder of the construction material and/or thick matter pump of FIG. 1 for displacing taken-in construction material and/or thick matter out of the conveying cylinder, a graph of a conveying variable that characterizes a pressure acting on construction material and/or thick matter in the conveying cylinder, a graph of a profile of a subsequent movement of the conveying piston, and a graph of a conveying variable that characterizes a position of a line switch of the construction material and/or thick matter pump of FIG. 1 of the method of FIG. 3.

In detail, the conveying variable FG' characterizes the pressure, in particular the drive pressure, p acting on construction material and/or thick matter DS in the conveying cylinder 2*a*, 2*b*, as shown in FIG. 4.

In the exemplary embodiment shown, the conveying sensor device 5' has a pressure sensor device.

Additionally, the conveying variable FG' characterizes an excitation AN of at least one part 8 of the construction material and/or thick matter pump 1 caused by the introduction of energy from the conveying piston 3*a*, 3*b* into construction material and/or thick matter DS, as shown in FIG. 2.

In the exemplary embodiment shown, the conveying sensor device 5' has an excitation sensor device, in particular an acceleration sensor device and/or a rate of rotation sensor device.

Furthermore, in the exemplary embodiment shown, the, in particular one, part 8 is the conveying line 8', in particular on the truck, and the, in particular other, part 8 is a conveyor boom 8", in particular with the excitation sensor device of the conveying sensor device 5' at a tip of the conveyor boom 8".

The method furthermore comprises: Determining a displacement start position POVA, at which the conveying piston 3*a*, 3*b* starts to displace taken-in construction material and/or thick matter DS out of the conveying cylinder 2*a*, 2*b*, by linking the detected position variable PGa, PGb during the movement for the displacement and the detected conveying variable FG' that characterizes the introduction of energy from the conveying piston 3*a*, 3*b* into construction material and/or thick matter DS during the movement for the displacement with one another, as shown in FIG. 4, in particular by means of the determining device 6. Determining the profile PR on the basis of the determined displacement start position POVA.

In the exemplary embodiment shown, the displacement start position POVA is determined by linking the detected position variable PGa, PGb during the displacement and the detected conveying variable FG' during the displacement with one another. In alternative exemplary embodiments, the displacement start position may be determined by linking the detected position variable during the movement to the determining displacement start position and the detected conveying variable during the movement to the determining displacement start position with one another.

Furthermore, in the exemplary embodiment shown, the displacement start position POVA is determined as that position POa, POb of the conveying piston 3*a*, 3*b* at which the conveying variable FG', in particular the pressure p, reaches or overshoots a limit value FG' limit, in particular plimit.

In FIG. 4, the conveying piston 3*a* moves, in particular from an intake or stroke end position POAE, to the right, as indicated by an arrow. The conveying piston 3*a* initially moves through a vacuum, or displaces construction material and/or thick matter DS that has not yet been taken in. The pressure p is thus low. As soon as the conveying piston 3*a* reaches a tip of conveying material and/or thick matter DS, the conveying piston 3*a* starts to displace or compress construction material and/or thick matter DS into a cylindrical shape but not yet displace said construction material and/or thick matter out of the conveying cylinder 2*a*. The pressure p thus increases. As soon as the conveying piston 3*a* has displaced or compressed construction material and/or thick matter DS into the cylindrical shape, the conveying piston 3*a* starts to displace construction material and/or thick matter DS out of the conveying cylinder 2*a*, in particular into the conveying line 8'. The pressure p thus reaches or overshoots the limit value plimit. The displacement start position POVA is thus determined.

Figure 6:
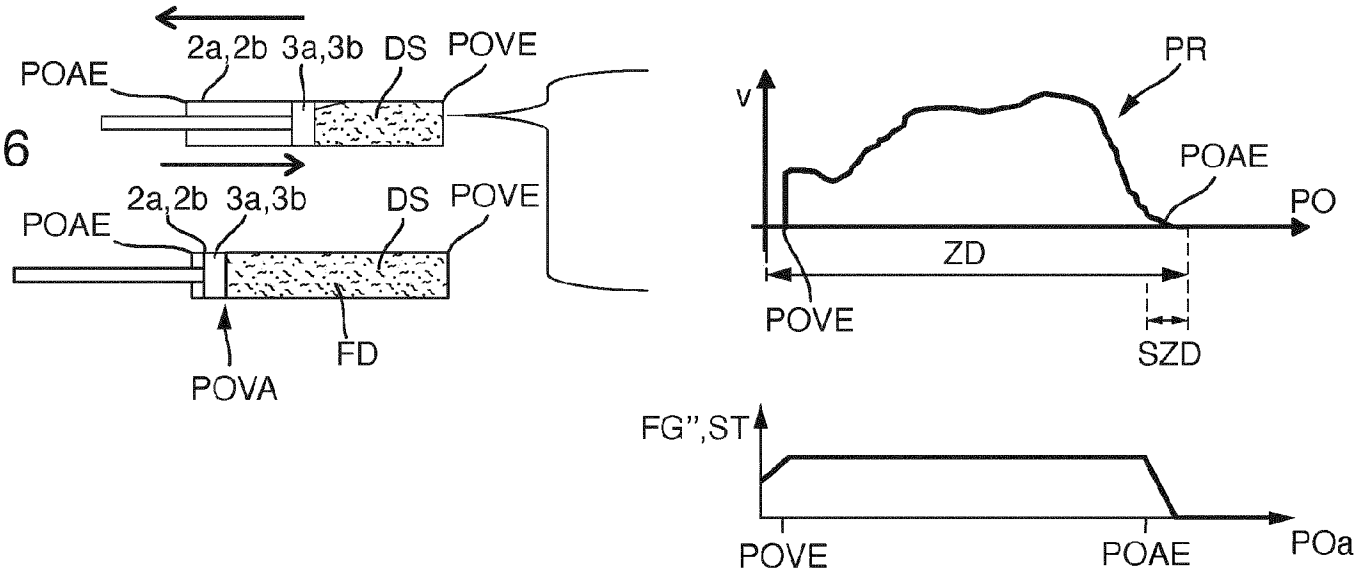
FIG. 6 shows a schematic view of the movement of the conveying piston for taking construction material and/or thick matter into the conveying cylinder, a graph of the profile of subsequent movement of the conveying piston, and a graph of the conveying variable that characterizes the position of the line switch of the method of FIG. 3.

In detail, the method comprises: Determining a degree of filling FD of the conveying cylinder 2*a*, 2*b* with construction material and/or thick matter DS on the basis of the determined displacement start position POVA, in particular by means of the determining device 6, as shown in FIG. 3. Determining the profile PR of a subsequent movement for the intake, in particular of a subsequent intake, on the basis of the determined degree of filling FD, as shown in FIG. 6. Controlling the subsequent movement for the intake, in particular of the subsequent intake, in accordance with the determined profile PR.

Figure 5:
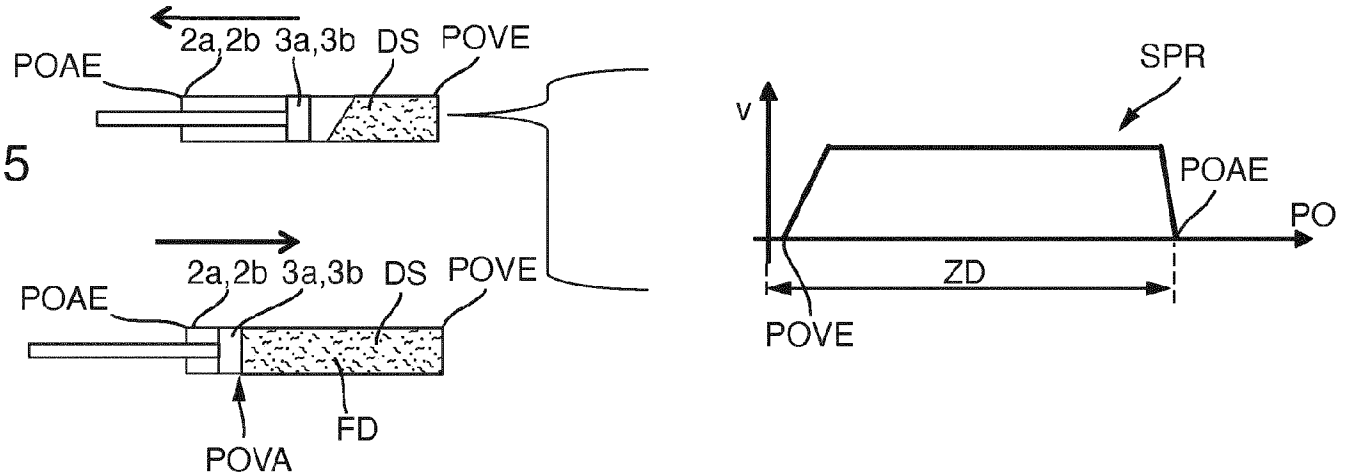
FIG. 5 shows a schematic view of a movement of the conveying piston for taking construction material and/or thick matter into the conveying cylinder, a graph of a profile of a preceding movement of the conveying piston, and a graph of the conveying variable that characterizes the position of the line switch of the method of FIG. 3.

The method furthermore comprises: Ascertaining a duration ZD for a preceding movement for the intake, in particular of a preceding intake, causing the determined displacement start position POVA and/or the determined degree of filling FD, as shown in FIG. 5, in particular by means of the determining device 6. Determining a conveying rate FM by linking the determined displacement start position POVA and/or the determined degree of filling FD and the ascertained duration ZD with one another, in particular by means of the determining device 6, as shown in FIG. 3. Determining the profile PR of the subsequent movement for the intake, in particular of the subsequent intake, on the basis of the determined conveying rate FM, as shown in FIG. 6.

The method furthermore comprises: Decreasing a speed v and/or increasing a standstill duration SZD of a profile, from that of a preceding intake SPR as shown in FIG. 5, to a subsequent intake PR as shown in FIG. 6, in particular by means of the determining device 6, until the displacement start position POVA no longer approaches the intake or stroke end position POAE and/or the degree of filling FD and/or the conveying rate FM no longer increase(s). Additionally or alternatively increasing a speed v and/or decreasing a standstill duration SZD of a profile, from that of a preceding intake SPR as shown in FIG. 5, to a subsequent intake PR as shown in FIG. 6, in particular by means of the determining device 6, until the displacement start position POVA moves away from the intake or stroke end position POAE and/or the degree of filling FD and/or the conveying rate FM decrease(s).

FIG. 5 shows a standard profile SPR, in particular a standard acceleration and deceleration ramp, of the in particular preceding movement of the conveying piston 3*a*, 3*b* for the intake, in particular of the preceding intake, of construction material and/or thick matter DS with a standard viscosity. However, if construction material and/or thick matter DS has not the standard viscosity but some other viscosity, then the standard profile SPR is non-optimal. In particular, the in particular determined displacement start position POVA is not as close as possible to the intake or stroke end position POAE, the in particular determined degree of filling FD is not at a maximum, and/or the in particular determined conveying rate FM is not at a maximum.

FIG. 6 shows the profile PR, determined in particular by adaptation, and in particular iteration, of the in particular subsequent movement of the conveying piston 3*a*, 3*b* for the intake, in particular of the subsequent intake, of construction material and/or thick matter DS. The profile PR has, in particular by contrast to the standard profile SPR, a high speed v at an intake or stroke start position and/or displacement or stroke end position POVE. This makes it possible to quickly generate a high initial intake vacuum. Furthermore, the profile PR has, in particular by contrast to the standard profile SPR, a high speed v in a middle between the displacement or stroke end position POVE and the intake or stroke end position POAE, or of the stroke HU. This makes the in particular determined short duration ZD possible. Furthermore, the profile PR has, in particular by contrast to the standard profile SPR, a low speed v and a long standstill duration SZD at the intake or stroke end position POAE. This allows a pronounced overtravel effect. This thus makes it possible to achieve a minimum vacuum. This thus advantageously makes it possible to achieve the in particular determined displacement start position POVA as close as possible to the intake or stroke end position POAE, the in particular determined maximum degree of filling FD at a maximum, and/or the in particular determined maximum conveying rate FM.

The method furthermore comprises: Determining the profile PR of a subsequent movement, in particular from the intake or stroke end position POAE, to a, in particular new or the, displacement start position POVA on the basis of the determined displacement start position POVA, as shown in FIG. 4. Controlling the subsequent movement to the displacement start position POAE in accordance with the determined profile PR.

In detail, the method comprises: Determining the profile PR such that the conveying piston 3*a*, 3*b* accelerates, in particular from the intake or stroke end position POAE, and subsequently decelerates before the deceleration start position POVA.

In other words: the profile PR has an increase of the speed v at the intake or stroke end position POAE and subsequently a decrease of the speed v before the displacement start position POVA.

This makes it possible for the displacement start position POVA to be reached in a minimum duration, without the conveying piston 3*a*, 3*b* moving against the construction material and/or thick matter DS at too high a speed.

The method furthermore comprises: ascertaining a duration ZD for the preceding movement for the intake and/or for the determined subsequent movement for the intake and/or for the preceding movement to the displacement start position POVA and/or for the determined subsequent movement to the displacement start position POVA, in particular by means of the determining device 6, as shown in FIG. 3. Determining a remaining duration RZD for a subsequent movement for the displacement, in particular of a subsequent displacement, and/or to the displacement or stroke end position POVE, by linking the ascertained duration ZD and a specified cycle and/or stroke duration HZD and/or a specified conveying rate FM with one another, in particular by means of the determining device 6, as shown in FIG. 3. Determining the profile PR of the subsequent movement for the displacement, in particular of the subsequent displacement, in particular to the displacement or stroke end position POVE, on the basis of the determined remaining duration RZD. Controlling the subsequent movement for the displacement, in particular controlling the subsequent displacement, in accordance with the determined profile PR.

The method furthermore comprises: Determining the profile PR of the subsequent movement for the displacement, in particular of the subsequent displacement, in particular to the displacement or stroke end position POVE, by linking the detected position variable PGa, PGb during the movement for the displacement, in particular during the displacement, and the detected conveying variable FG' which characterizes the introduction of energy from the conveying piston 3*a*, 3*b* into construction material and/or thick matter DS, which in the exemplary embodiment shown characterizes an excitation AN of at least one part 8 of the construction material and/or thick matter pump 1 caused by the introduction of energy from the conveying piston 3*a*, 3*b* into construction material and/or thick matter DS, during the movement for the displacement, in particular during displacement, with one another such that an excitation AN of at least the one part 8 of the construction material and/or thick matter pump 1 caused by the introduction of energy from the conveying piston 3*a*, 3*b* into construction material and/or thick matter DS is reduced or prevented. Controlling the subsequent movement for the displacement, in particular controlling the subsequent displacement, in accordance with the determined profile PR.

FIG. 4 shows the profile PR determined in particular by adaptation, and in particular iteration, of the in particular subsequent movement of the conveying piston 3*a*, 3*b* for the displacement, in particular of the subsequent displacement, of construction material and/or thick matter DS. The profile PR has an increase of the speed v after the displacement start position POVA and subsequently a decrease of the speed v before the displacement or stroke end position POVE. In other words, the method comprises: Determining the profile PR such that the conveying piston 3*a*, 3*b* decelerates from the displacement start position POVA and subsequently before the displacement or stroke end position POVE. This makes it possible to reduce or prevent the remaining duration ZD and thus the cycle and/or stroke duration HZD and/or the conveying rate FM and/or an excitation AN of at least the one part 8.

Furthermore, the conveying variable FG" characterizes a position ST of the line switch 9, as shown in FIGS. 2, 4 and 6.

In the exemplary embodiment shown, the conveying sensor device 5" has a position sensor device.

Furthermore, in the exemplary embodiment shown, the construction material and/or thick matter pump 1 has an actuating system 19 for adjusting the line switch 9.

Furthermore, in the exemplary embodiment shown, the conveying variable FG" is a position of the actuating system 19. In alternative exemplary embodiments, the conveying variable may be the position of the line switch.

Furthermore, the control device 7 is configured to control, in particular controls, the actuating system 19, as shown in FIG. 3.

In detail, the method comprises: Determining the profile PR of the subsequent movement for the displacement to the displacement or stroke end position POVE and/or for the intake from the displacement or stroke end position POVE and/or for the intake to the intake or stroke end position POAE and/or for the displacement from the intake or stroke end position POAE by linking the detected position variable PGa, PGb and the detected conveying variable FG" that characterizes the position ST of the line switch 9 with one another such that the subsequent movement of the conveying piston 3*a*, 3*b* and the in particular subsequent adjustment of the line switch 9 are or have been synchronized, as shown in FIGS. 4 and 6. Controlling the subsequent movement to the displacement or stroke end position POVE and/or from the displacement or stroke end position POVE and/or to the intake or stroke end position POAE and/or from the intake or stroke end position POAE in accordance with the determined profile PR.

FIGS. 4 and 6 show the profile PR, determined in particular by adaptation, and in particular iteration, of the in particular subsequent movement of the conveying piston 3*a*, 3*b* to the displacement or stroke end position POVE and/or from the displacement or stroke end position POVE and/or to the intake or stroke end position POAE and/or from the intake or stroke end position POAE. The profile PR is determined such that the conveying piston 3*a*, 3*b* is, or is at a standstill, in the displacement or stroke end position POVE and/or the intake or stroke end position exactly when the adjustment of the line switch 9 starts, and/or accelerates from said position exactly when the adjustment of the line switch 9 has ended.

In particular, the adjustment of the line switch 9 is somewhat inert. The deceleration and/or the acceleration of the conveying piston 3*a*, 3*b* is also somewhat inert. The adjustment of the line switch 9 is thus initiated, in particular by the control device 7, before the conveying piston 3*a*, 3*b* is, or is at a standstill, in the displacement or stroke end position POVE and/or the intake or stroke end position. Furthermore, the acceleration of the conveying piston 3*a*, 3*b* is thus initiated, in particular by the control device 7, before the line switch 9 has been adjusted.

In particular at a time after the initiation of the adjustment of the line switch 9, through the detection of the position variable PGa, PGb and the conveying variable FG" that characterizes the position ST of the line switch 9, and the linking of these with one another, the profile PR is determined such that, if construction material and/or thick matter DS has not the standard viscosity but a different viscosity, the conveying piston 3*a*, 3*b* decelerates to a lesser or greater extent such that the conveying piston 3*a*, 3*b* is, or is at a standstill, in the displacement or stroke end position POVE and/or the intake or stroke end position exactly when the adjustment of the line switch 9 starts.

In particular at a time after the initiation of the acceleration of the conveying piston 3*a*, 3*b*, detection of the position variable PGa, PGb and the conveying variable FG" that characterizes the position ST of the line switch 9, and the linking of these with one another, the profile PR is determined such that, if construction material and/or thick matter DS has not the standard viscosity but a different viscosity, the conveying piston 3*a*, 3*b* accelerates to a lesser or greater extent such that the conveying piston 3*a*, 3*b* accelerates from the displacement or stroke end position POVE and/or the intake or stroke end position exactly when the adjustment of the line switch 9 has ended.

This allows the construction material and/or thick matter pump 1 to be operated with low wear and/or without problems, and/or for construction material and/or thick matter DS to be conveyed by means of the construction material and/or thick matter pump 1 with the least possible interruption.

The method furthermore has the step: Selecting an optimization target OZ set of several selectable optimization targets OZ. The method comprises: determining the profile PR in accordance with the selected optimization target OZ, in particular such that the selected optimization target OZ is achieved.

In the exemplary embodiment shown, the construction material and/or thick matter pump 1 has a user-actuatable operator control element 30 for the selection of the optimization target OZ, as shown in FIG. 1.

Furthermore, the at least one travel sensor device 4*a*, 4*b*, the at least one conveying sensor device 5', 5", the determining device 6 and the control device 7, and in particular the drive motor device 13, the drive pump device 14, the actuating system 19 and the operator control element 30 in particular each have an in particular electrical signal connection, as shown in FIG. 1 by dotted lines.

As is made clear by the exemplary embodiments presented and discussed above, the invention provides an advantageous method for operating a construction material and/or thick matter pump for conveying construction material and/or thick matter, and an advantageous construction material and/or thick matter pump for conveying construction material and/or thick matter, which each have improved characteristics.

The invention claimed is:

1. A method for operating a construction material and/or thick matter pump for conveying construction material and/or thick matter, wherein the construction material and/or thick matter pump comprises:

a conveying cylinder being configured to receive and discharge the construction material and/or thick matter, and a conveying piston, the conveying piston being arranged movably in the conveying cylinder in order to take in the construction material and/or thick matter into the conveying cylinder and in order to displace taken-in construction material and/or thick matter out of the conveying cylinder, the method comprising:

conveying the construction material and/or thick matter by movement of the conveying piston in order to take in and displace the construction material and/or thick matter;

detecting a position variable during the movement, the position variable characterizing a position of the conveying piston along a conveying piston stroke in the conveying cylinder;

detecting a conveying variable during the movement, the conveying variable being distinct from the position variable and representing a value of a pressure acting on the construction material and/or thick matter in the conveying cylinder;

determining a displacement start position, at which the conveying piston starts to displace the taken-in construction material and/or thick matter out of the conveying cylinder, by correlating the detected position variable during the movement for the displacement and the detected conveying variable during the movement for the displacement, with one another, wherein the displacement start position is determined as the position of the conveying piston at which the pressure and/or a chronological increase the pressure reaches or overshoots a specified limit value;

adapting a profile for a subsequent movement of the conveying piston based on the determined displacement start position, by:

(a) decreasing a speed and/or increasing a standstill duration of a profile from a preceding intake to a subsequent intake until the displacement start position no longer approaches an intake end position, or (b) increasing the speed and/or decreasing the standstill duration of the profile from the preceding intake to the subsequent intake until the displacement start position moves away from the intake end position; and controlling the subsequent movement in accordance with the adapted profile.

* * * * *